US009069298B2

(12) United States Patent
Mikutsu

(10) Patent No.: US 9,069,298 B2
(45) Date of Patent: Jun. 30, 2015

(54) SEPARATION DEVICE, FIXING DEVICE, AND IMAGE FORMING APPARATUS

(71) Applicant: Yasunari Mikutsu, Tokyo (JP)

(72) Inventor: Yasunari Mikutsu, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 41 days.

(21) Appl. No.: 13/953,796

(22) Filed: Jul. 30, 2013

(65) Prior Publication Data

US 2014/0050511 A1 Feb. 20, 2014

(30) Foreign Application Priority Data

Aug. 16, 2012 (JP) ..... 2012-180469

(51) Int. Cl.
*G03G 15/20* (2006.01)

(52) U.S. Cl.
CPC ..... *G03G 15/2028* (2013.01); *G03G 15/2085* (2013.01)

(58) Field of Classification Search
CPC ..... G03G 15/2028; G03G 15/2085; G03G 2215/00573
USPC ..... 399/323, 398, 399
See application file for complete search history.

(56) References Cited

U.S. PATENT DOCUMENTS 5,837,366 A * 11/1998 Tanaka
2008/0107436 A1 5/2008 Mikutsu
2009/0003897 A1* 1/2009 Yamada ..... 399/323
2010/0239295 A1 9/2010 Mikutsu
2010/0310287 A1 12/2010 Mikutsu
2011/0091226 A1 4/2011 Ishigaya et al.
2013/0121735 A1 5/2013 Mikutsu
2013/0330110 A1* 12/2013 Yoshikawa ..... 399/323

FOREIGN PATENT DOCUMENTS

JP 2006133430 A * 5/2006
JP 2006-189688 7/2006
JP 2007140189 A * 6/2007
JP 2009-031759 2/2009

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

A separation device includes at least one separator disposed opposite one of a first rotary body and a second rotary body. Each separator includes a front aligned in an axial direction of the one of the first rotary body and the second rotary body and including a recording medium conveyance face over which a recording medium slides. The recording medium conveyance face includes a front edge produced with a burr having a height not greater than about 25 micrometers. A recess produced on the recording medium conveyance face extends in a direction perpendicular to a recording medium conveyance direction. The recording medium conveyance face has a surface roughness defined by one of an arithmetic average roughness not greater than about 1.5 micrometers, a maximum height not greater than about 10.0 micrometers, and a ten point average roughness not greater than about 7.2 micrometers.

16 Claims, 5 Drawing Sheets

FIG. 6A
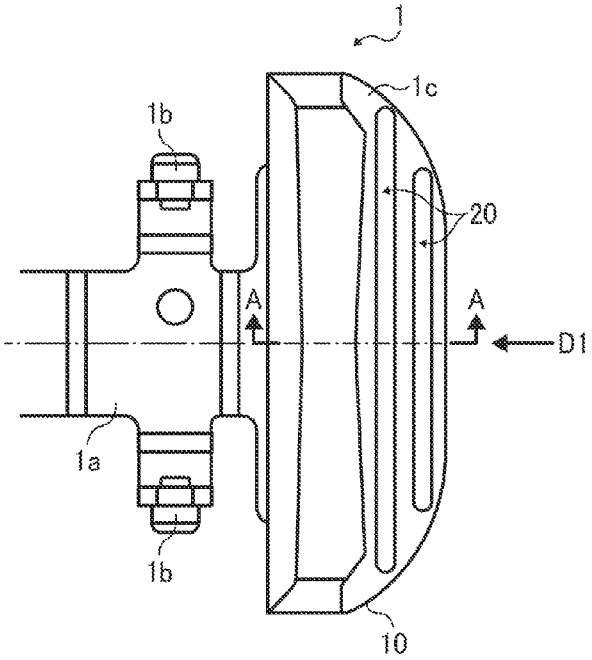
FIG. 6B
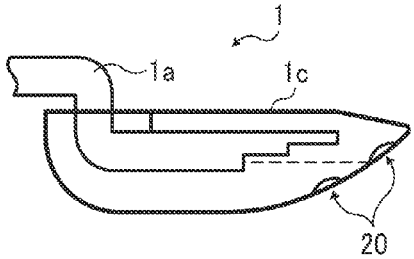
FIG. 7
Unit: [μm]
| SURFACE PROPERTY | COMPARATIVE SEPARATOR WITHOUT RECESSES | | | SEPARATOR WITH RECESSES | | |
|---|---|---|---|---|---|---|
| ARITHMETIC AVERAGE ROUGHNESS | 2.08 | 1.71 | 0.48 | 1.52 | 0.93 | 0.21 |
| MAXIMUM HEIGHT | 19.97 | 12.12 | 2.80 | 10.10 | 6.51 | 2.21 |
| TEN POINT AVERAGE ROUGHNESS | 14.08 | 9.68 | 1.24 | 7.24 | 4.92 | 0.95 |
| FAILURE | FAULTY TONER IMAGE | NO | FAULTY CON-VEYANCE | NO | NO | NO |

SEPARATION DEVICE, FIXING DEVICE, AND IMAGE FORMING APPARATUS

CROSS-REFERENCE TO RELATED APPLICATION

This patent application is based on and claims priority pursuant to 35 U.S.C. §119 to Japanese Patent Application No. 2012-180469, filed on Aug. 16, 2012, in the Japanese Patent Office, the entire disclosure of which is hereby incorporated by reference herein.

BACKGROUND

1. Field

Example embodiments generally relate to a separation device, a fixing device, and an image forming apparatus, and more particularly, to a separation device for separating a recording medium from a rotary body and a fixing device and an image forming apparatus incorporating the separation device.

2. Discussion of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body such as a fixing roller and a fixing belt and a pressing rotary body such as a pressing roller and a pressing belt pressed against the fixing rotary body to form a fixing nip therebetween through which a recording medium bearing a toner image is conveyed. As the fixing rotary body and the pressing rotary body rotate and convey the recording medium through the fixing nip, the fixing rotary body and the pressing rotary body apply heat and pressure to the recording medium, melting toner of the toner image and fixing the toner image on the recording medium.

Since toner is made of resin, as it is melted at the fixing nip, it may adhere to the fixing rotary body. To address this circumstance, various configurations are proposed. For example, a separation pawl may be disposed opposite the fixing rotary body to separate the recording medium from the fixing rotary body and therefore prevent adhesion of toner of the toner image from the recording medium to the fixing rotary body. However, as the separation pawl separates the recording medium from the fixing rotary body, the toner image on the recording medium may come into contact with the separation pawl.

Since the separation pawl is situated in proximity to the fixing nip, the toner image on the recording medium may come into contact with the separation pawl before toner of the toner image melted while the recording medium passes through the fixing nip has been cooled. When the toner image melted and softened at the fixing nip comes into contact with the separation pawl, the toner image is subject to damage. For example, if a recording medium conveyance face of the separation pawl over which the recording medium slides is rough, the rough face may scratch the softened toner image, degrading the toner image into a streaky toner image. Conversely, if the recording medium conveyance face of the separation pawl is excessively smooth, the melted toner of the toner image may be subject to adhesion to the separation pawl, increasing frictional resistance between the toner image on the recording medium and the separation pawl and hindering conveyance of the recording medium.

To address this circumstance, a center separation pawl and lateral end separation pawls may be disposed opposite the fixing rotary body to separate the recording medium from the fixing rotary body. The lateral end separation pawls project beyond the center separation pawl toward the recording medium. However, as the recording medium bearing the toner image is discharged from the fixing nip, the recording medium may contact the lateral end separation pawls with increased pressure therebetween, producing a sharp streak on the toner image on the recording medium.

SUMMARY

At least one embodiment may provide a separation device disposed downstream from a first rotary body and a second rotary body contacting the first rotary body in a recording medium conveyance direction in which a recording medium is conveyed between the first rotary body and the second rotary body. The separation device includes at least one separator disposed opposite one of the first rotary body and the second rotary body. Each of the at least one separator includes a front aligned in an axial direction of the one of the first rotary body and the second rotary body and including a recording medium conveyance face over which the recording medium slides. The recording medium conveyance face includes a front edge produced with a burr having a height not greater than about 25 micrometers. A recess produced on the recording medium conveyance face extends in a direction perpendicular to the recording medium conveyance direction. The recording medium conveyance face has a surface roughness defined by one of an arithmetic average roughness not greater than about 1.5 micrometers, a maximum height not greater than about 10.0 micrometers, and a ten point average roughness not greater than about 7.2 micrometers.

At least one embodiment may provide a fixing device that includes a first rotary body, a second rotary body contacting the first rotary body, and a separation device disposed downstream from the first rotary body and the second rotary body in a recording medium conveyance direction in which a recording medium is conveyed between the first rotary body and the second rotary body. The separation device includes at least one separator disposed opposite one of the first rotary body and the second rotary body. Each of the at least one separator includes a front aligned in an axial direction of the one of the first rotary body and the second rotary body and including a recording medium conveyance face over which the recording medium slides. The recording medium conveyance face includes a front edge produced with a burr having a height not greater than about 25 micrometers. A recess produced on the recording medium conveyance face extends in a direction perpendicular to the recording medium conveyance direction. The recording medium conveyance face has a surface roughness defined by one of an arithmetic average roughness not greater than about 1.5 micrometers, a maximum height not greater than about 10.0 micrometers, and a ten point average roughness not greater than about 7.2 micrometers.

At least one embodiment may provide an image forming apparatus that includes the separation device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein:

FIG. 6A is a plan view of the separator shown in FIG. 5A illustrating recesses produced thereon;

FIG. 6B is a partial side view of the separator shown in FIG. 6A;

FIG. 7 is a lookup table showing results of a measurement conducted with the separator with the recesses shown in FIG. 6A and a comparative separator without the recesses.

Figure 1:
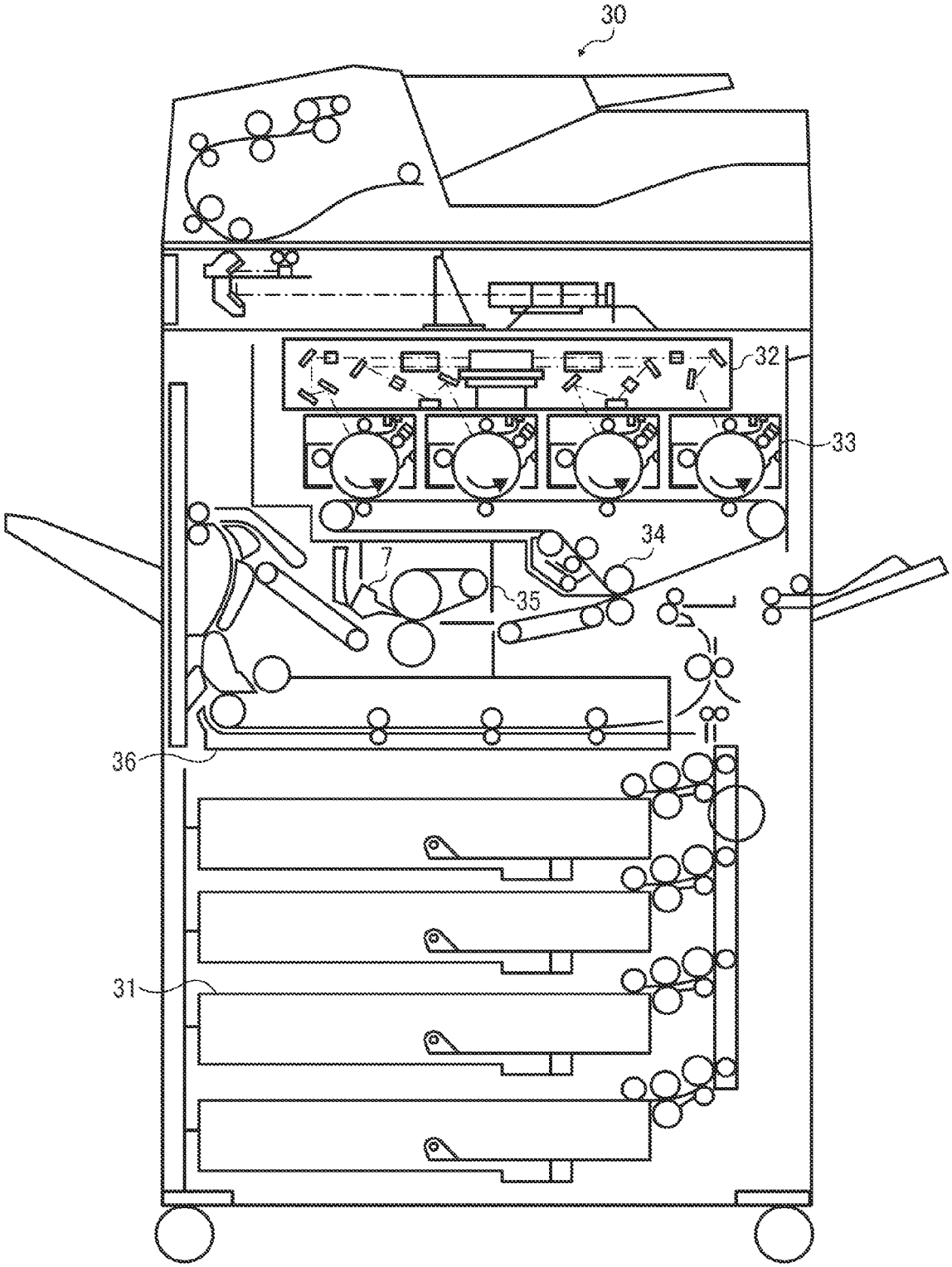
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 30 according to an example embodiment is explained.

FIG. 1 is a schematic vertical sectional view of the image forming apparatus 30. The image forming apparatus 30 may be a copier, a facsimile machine, a printer, a multifunction peripheral (MFP) having at least one of copying, printing, scanning, facsimile, and plotter functions, or the like. According to this example embodiment, the image forming apparatus 30 is a tandem color copier that forms color and monochrome toner images on recording media by electrophotography.

The image forming apparatus 30 has a typical structure including an image forming device 33 (e.g., an image forming unit) constructed of a photoconductor surrounded by image forming components such as a charger, a writer 32 (e.g., a writing unit), a development device, and the like. Hence, a brief description of a configuration and an operation of the image forming apparatus 30 is provided below.

As shown in FIG. 1, a recording medium (e.g., a sheet) is conveyed from one of paper trays 31 loading a plurality of recording media to a transfer device 34. On the other hand, the writer 32 emits a laser beam onto the photoconductor of the image forming device 33 according to a signal sent from a scanner for reading an image on an original or a signal sent from an external device such as a client computer, thus forming an electrostatic latent image on the photoconductor.

The image forming device 33 visualizes the electrostatic latent image formed on the photoconductor as a toner image that is primarily transferred onto a transfer belt. The transfer unit 34 secondarily transfers the toner image onto the recording medium conveyed from the paper tray 31. After a fixing device 35 fixes the toner image on the recording medium, a separation device 7 (e.g., a separation unit) separates the recording medium bearing the toner image from a fixing belt incorporated in the fixing device 35. Thereafter, the recording medium is discharged onto an outside of the image forming apparatus 30. For duplex printing, a duplex unit 36 reverses and conveys the recording medium to the transfer unit 34. After another toner image is secondarily transferred from the transfer belt onto the recording medium, the recording medium is conveyed through the fixing device 35 incorporating the separation device 7 and discharged onto the outside of the image forming apparatus 30.

Figure 2:
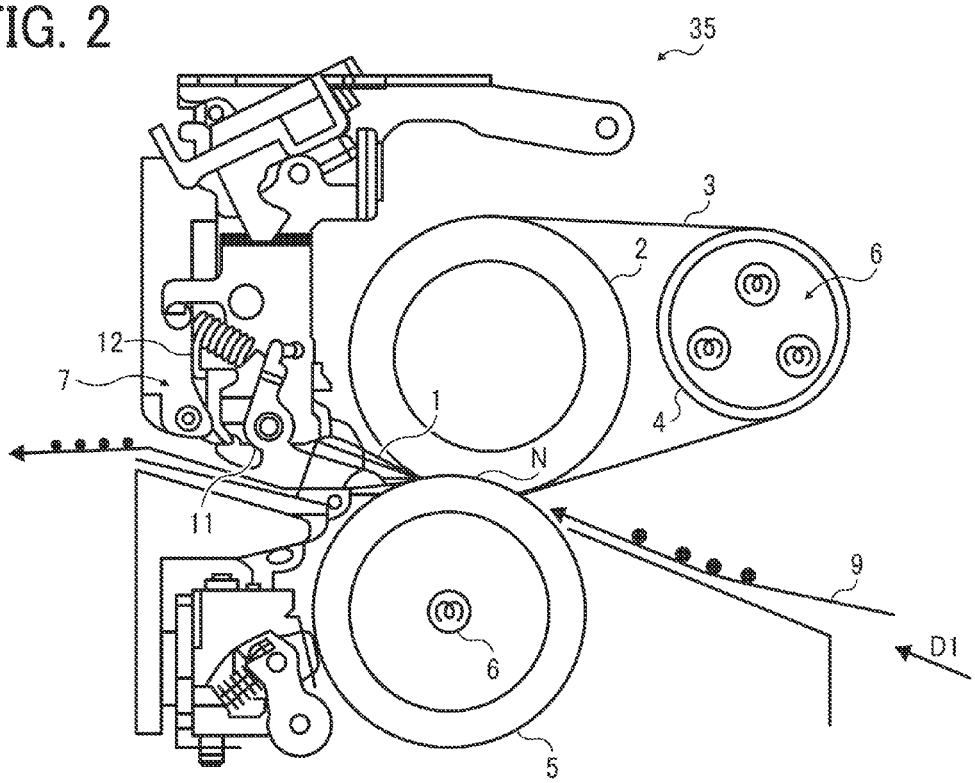
FIG. 2 is a vertical sectional view of a fixing device incorporated in the image forming apparatus shown in FIG. 1.

With reference to FIG. 2, a description is provided of a configuration of the fixing device 35 incorporated in the image forming apparatus 30.

FIG. 2 is a vertical sectional view of the fixing device 35 incorporating the separation device 7. FIG. 2 shows a cross-section perpendicular to an axial direction of a fixing roller 2 and a pressing roller 5 incorporated in the fixing device 35. As shown in FIG. 2, the fixing roller 2 and a heating roller 4 are located inside a loop formed by a fixing belt 3. The pressing roller 5 is pressed against the fixing roller 2 via the fixing belt 3, forming a fixing nip N between the pressing roller 5 and the fixing belt 3. A plurality of halogen heaters 6 serving as a heater or a heat source is situated inside the heating roller 4; a single halogen heater 6 serving as a heater or a heat source is situated inside the pressing roller 5. As a recording medium 9 conveyed from the transfer device 34 depicted in FIG. 1 in a recording medium conveyance direction D1 passes through the fixing nip N, the fixing belt 3 heated by the halogen heaters 6 through the heating roller 4 and the pressing roller 5 heated by the halogen heater 6 apply heat and pressure to the recording medium 9, thug fixing the toner image on the recording medium 9.

A detailed description is now given of a construction of the fixing belt 3.

The fixing belt 3 is constructed of a base layer constituting an inner surface layer, a silicone rubber layer coating the base layer, and a coating constituting an outer surface layer. For example, the base layer, made of polyimide resin, has an inner diameter of about 75 mm and a thickness of about 90 micrometers. The silicone rubber layer has a thickness of about 200 micrometers. The coating, made of tetrafluoroethylene perfluoroalkyl vinyl ether copolymer (PFA), has a thickness of about 20 micrometers. The fixing belt 3 is looped across the fixing roller 2 and the heating roller 4. For example, the fixing roller 2, made of silicone rubber foam, has an outer diameter of about 52 mm and a thickness of about 14 mm. The heating roller 4 is a hollow aluminum tube having an outer diameter of about 35 mm and a thickness of about 0.6 mm.

A detailed description is now given of a construction of the pressing roller 5.

The pressing roller 5 having an outer diameter of about 50 mm is constructed of a hollow metal core made of steel and having a thickness of about 1 mm, a silicone rubber layer coating the metal core and having a thickness of about 1.5 mm, and a PFA tube constituting an outer surface layer. The fixing roller 2 is recessed by about 3 mm by the pressing roller 5 pressed against the fixing roller 2 via the fixing belt 3, producing the fixing nip N having a length of about 14 mm in the recording medium conveyance direction D1.

A detailed description is now given of a configuration of the separation device 7.

The separation device 7, formed in a unit, is situated downstream from the fixing nip N in the recording medium conveyance direction D1. The separation device 7 is disposed opposite the fixing belt 3 to separate the recording medium 9 from the fixing belt 3 or peel the recording medium 9 off the fixing belt 3. The separation device 7 includes a separator 1 (e.g., a separation pawl) serving as a front of the separation device 7 that is disposed opposite the fixing nip N. According to this example embodiment, a plurality of separators 1 is aligned in the axial direction of the fixing roller 2 and the pressing roller 5. Alternatively, the separator 1 may be a pawl extending continuously in the axial direction of the fixing roller 2 and the pressing roller 5 throughout the entire width of the recording medium 9 of the maximum size available in the fixing device 35. In this case, the separator 1 may be a separation plate. However, according to this example embodiment, such separation plate may also be called a separation pawl. The recording medium 9 separated from the fixing belt 3 by the separator 1 is conveyed to an output device (e.g., an output roller pair), situated downstream from the separation device 7 in the recording medium conveyance direction D1, that discharges the recording medium 9 onto the outside of the image forming apparatus 30, while the recording medium 9 is guided by a fixing guide disposed opposite the fixing belt 3 and downstream from the fixing nip N in the recording medium conveyance direction D1 and a pressing guide disposed opposite the pressing roller 5 and downstream from the fixing nip N in the recording medium conveyance direction D1.

Figure 3:
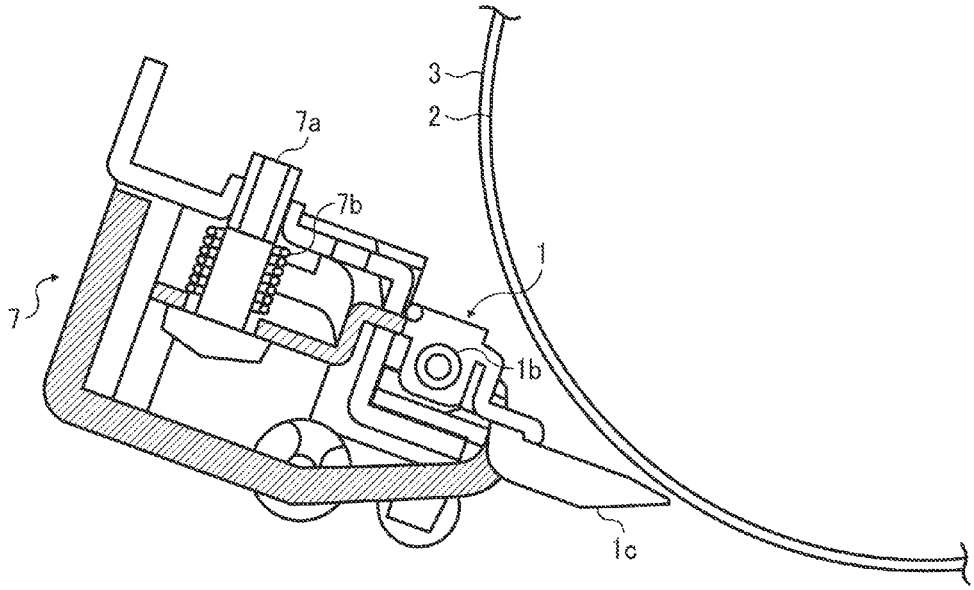
FIG. 3 is a partial vertical sectional view of a separation device incorporated in the image forming apparatus shown in FIG. 1.

A tension spring 12 anchored to a lever 11 mounting the separator 1 biases the separator 1 against the fixing belt 3. FIG. 3 is a partial vertical sectional view of the separation device 7. The separator 1 is rotatable about a shaft 1*b*. As shown in FIG. 3, the separator 1 includes a front 1*c* disposed opposite the fixing belt 3. A compression spring 7*b* anchored to the separator 1 and a screw 7*a* pressing and releasing the compression spring 7*b* perform fine adjustment of the position of the front 1*c* of the separator 1 relative to the fixing belt 3. The screw 7*a* is screwed through a through-hole serving as a securing member produced in the separation device 7 such that the screw 7*a* projects from and retracts into the through-hole. As the screw 7*a* rotates, the separator 1 rotates or swings about the shaft 1*b*. Accordingly, the screw 7*a* may bring the front 1*c* of the separator 1 into contact with the fixing belt 3 or isolate the front 1*c* of the separator 1 from the fixing belt 3 with a given interval therebetween in a range of from about 0.1 mm to about 0.6 mm, for example. As the separator 1 contacts the fixing belt 3, the separator 1 separates the recording medium 9 from the fixing belt 3 precisely. As the separator 1 is isolated from the fixing belt 3 with the given interval therebetween, the separator 1 prohibits the fixing belt 3 from sliding over the separator 1 while retaining separation performance for separating the recording medium 9 from the fixing belt 3 that is equivalent to separation performance achieved as the separator 1 contacts the fixing belt 3, thus preventing scratches on an outer circumferential surface of the fixing belt 3 that may be produced by the separator 1.

As described above, the separation device 7 incorporating the separator 1 is installed in the fixing device 35. However, the image forming apparatus 30 depicted in FIG. 1 incorporates various devices that employ a mechanism for separating the recording medium 9 from a belt or a roller. Accordingly, the separation device 7 incorporating the separator 1 may be employed by the transfer device 34 depicted in FIG. 1 as one example of such mechanism. Further, the separation device 7 incorporating the separator 1 may be employed by other apparatuses and devices as a mechanism for separating a sheet from a belt or a roller.

Figure 4:
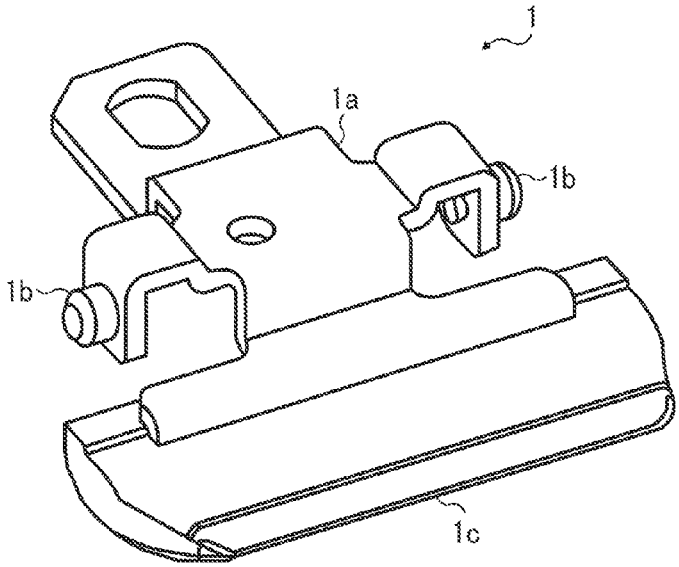
FIG. 4 is a perspective view of a separator incorporated in the separation device shown in FIG. 3.

With reference to FIG. 4, a description is provided of a configuration of the separator 1.

FIG. 4 is a perspective view of the separator 1. The plurality of separators 1 is aligned in the axial direction of the fixing roller 2 depicted in FIG. 2. As shown in FIG. 4, the separator 1 includes a base 1*a*, the shafts 1*b* mounted on the base 1*a*, and the front 1*c* situated at a position farthest from the shafts 1*b*. The front 1*c*, made of resin softer than resin of the base 1*a*, is integrally molded with the base 1*a* by insert molding. Hence, even if the recording medium 9 is jammed between the fixing belt 3 and the pressing roller 5, the separator 1 is not deformed permanently by pressure from the recording medium 9. Further, since the front 1*c* of the separator 1 is made of soft resin, the separator 1 does not damage the recording medium 9.

Since the front 1*c* is integrally molded with the base 1*a* by insert molding, the front 1*c* is positioned relative to the shafts 1*b* mounted on the base 1*a* precisely. Accordingly, although the front 1*c* is made of a material different from a material of the base 1*a*, the separator 1 achieves separation performance equivalent to that of a separator made of an identical material.

Figure 5A:
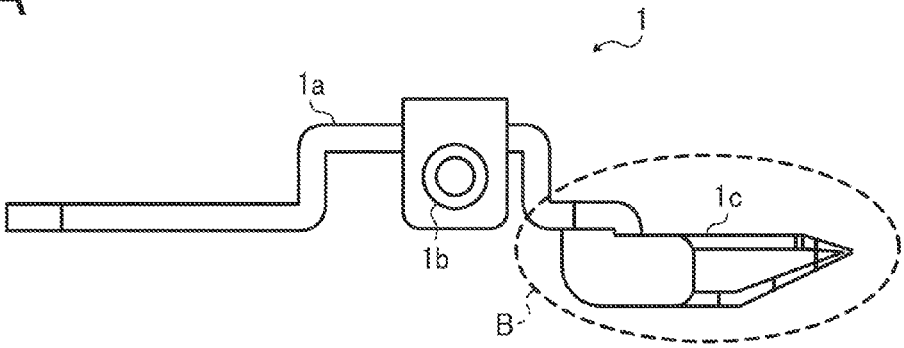
FIG. 5A is a side view of the separator shown in FIG. 4.
Figure 5B:
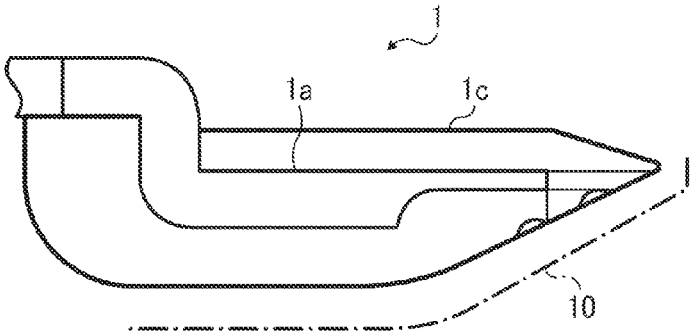
FIG. 5B is a partially enlarged sectional view of the separator shown in FIG. 5A.

With reference to FIGS. 5A and 5B, a detailed description is now given of a configuration of the separator 1.

FIG. 5A is a side view of the entire separator 1. FIG. 5B is a partially enlarged sectional view of the separator 1 illustrating the front 1*c* of the separator 1 indicated by the dotted line B in FIG. 5A. As shown in FIG. 5B, the front 1*c* shown in solid outline is a resin pawl integrally molded with the base 1*a* by insert molding such that the front 1*c* surrounds a front portion of the base 1*a*. The front 1*c* is made of fluoroplastic. Since fluoroplastic facilitates sliding of the recording medium 9 over the front 1*c*, even if the recording medium 9 comes into contact with the front 1*c* of the separator 1, the front 1*c* does not damage the recording medium 9. Additionally, since fluoroplastic facilitates releasing of toner of the toner image on the recording medium 9, toner does not adhere to the front 1*c*. Accordingly, the front 1*c* made of fluoroplastic prevents adhesion of toner from the recording medium 9 to the separator 1. Alternatively, the front 1*c* may be made of polyetheretherketone (PEEK), polyamide imide (PAI), polyimide (PI), or the like and a recording medium conveyance face 10 of the front 1*c*, of which span is indicated by the alternate long and short dashed lines and over which the recording medium 9 slides, may be coated with fluoroplastic. Thus, such alternative front 1*c* also prevents adhesion of toner to the recording medium conveyance face 10 of the separator 1. The front 1*c* coated with fluoroplastic in the recording medium conveyance face 10 thereof facilitates production of smooth surface of the separator 1. Conversely, the front 1*c* made of fluoroplastic prevents abrasion and wear that may appear on the front 1*c* coated with fluoroplastic.

FIG. 6A is a plan view of the separator 1 illustrating the recording medium conveyance face 10 thereof. FIG. 6B is a partial side view of the separator 1. As shown in FIG. 6A, a plurality of recesses 20 is produced on the recording medium conveyance face 10 of the front 1*c* of the separator 1. Each recess 20 extends in an extension direction A perpendicular to the recording medium conveyance direction D1. For example, the extension direction A of the recess 20 and the recording medium conveyance direction D1 form an angle θ of about 90 degrees. The recess 20 extends substantially throughout the entire width of the front 1*c* in the extension direction A of the recess 20. According to this example embodiment, the plurality of separators 1 is aligned in a width direction of the recording medium 9 of maximum size available in the fixing device 35 that is parallel to the axial direction of the fixing roller 2 and the fixing belt 3 throughout the entire width of the recording medium 9. Alternatively, the separator 1 may be a separation plate continuously extending throughout the entire width of the recording medium 9 of maximum size. In this case also, the recesses 20 extend substantially throughout the entire width of the separation plate in the width direction of the recording medium 9.

Incidentally, after various types of recording media 9 bearing various types of toner images slide over the separator 1, the separator 1 may be subject to abrasion over time and the recording medium conveyance face 10 may be smoothed. If the recording medium conveyance face 10 of the separator 1 is excessively smooth, toner of the toner image melted while passing through the fixing nip N may be subject to adhesion to the smooth recording medium conveyance face 10 of the separator 1, increasing frictional resistance between the toner image on the recording medium 9 and the separator 1 and hindering conveyance of the recording medium 9.

Difficulty in conveyance of the recording medium 9 may often occur when coated paper is used as a recording medium 9. The coated paper is produced by coating paper fiber with a surface resin layer. The rigidity of the coated paper decreases as the coated paper is heated at the fixing nip N. Accordingly, the rigidity of the coated paper is not great enough to resist adhesive force of melted toner of the toner image on the coated paper to adhere to the separator 1. Consequently, the melted toner may be subject to adhesion to the separator 1, hindering conveyance of the coated paper.

Further, toner adhered to the separator 1 may scratch the toner image on the recording medium 9, resulting in formation of a streaky toner image.

To address this circumstance, the surface roughness of the recording medium conveyance face 10 of the front 1*c* of the separator 1 may be determined based on a measurement described below.

With reference to FIG. 7, a description is provided of a measurement for measuring the surface roughness of the recording medium conveyance face 10 of the front 1*c* of the separator 1 with the recesses 20 according to this example embodiment and a comparative separator without the recesses 20.

The measurement was conducted with a contact surface roughness measurement device available from Mitutoyo Corporation using a stylus having a point diameter of 2 microns. As thin coated paper (e.g., a thin coated sheet) used as a recording medium 9 was conveyed at a speed of 1 mm/s for a length of 20 mm, the ten point average roughness under Japanese Industrial Standards 1994 was measured. Thus, conveyance performance for conveying the thin coated sheet and image quality (e.g., formation of a faulty streaky image) were examined.

FIG. 7 is a lookup table showing a relation between the shape and surface property of the recording medium conveyance face 10 of the front 1*c* and the conveyance performance and image quality for the separator 1 with the recesses 20 and the comparative separator without the recesses 20. The arithmetic average roughness defines an average Ra obtained by extracting a reference length from a roughness curve in an average line direction and summing absolute values of deviation from the extracted average line to a measured curve. The maximum height defines a sum Ry obtained by extracting the reference length from the roughness curve in the average line direction and adding a depth of a lowest trough to a height of a highest crest from the extracted average line. The ten point average roughness defines a sum Rz obtained by extracting the reference length from the roughness curve in the average line direction and adding an average of absolute values of height of a highest crest to a fifth highest crest to an average of absolute values of height of a lowest trough to a fifth lowest trough from the extracted average line.

With the comparative separator without the recesses, when the arithmetic average roughness was not smaller than 2.08 micrometers, the sum Ry, that is, the maximum height, was not smaller than 19.97 micrometers, and the sum Rz, that is, the ten point average roughness, was not smaller than 14.08 micrometers, a faulty streaky toner image was formed on the recording medium 9. Further, with the comparative separator without the recesses 20, when the arithmetic average roughness was not greater than 0.48 micrometers, the maximum height was not greater than 2.80 micrometers, and the ten point average roughness was not greater than 1.24 micrometers, faulty conveyance of the recording medium 9 occurred. Faulty conveyance resulted from an increased frictional resistance between the comparative separator and the recording medium 9 sliding over the comparative separator caused by an increased adhesion of toner of the toner image on the recording medium 9 to the excessively smooth recording medium conveyance face 10.

Conversely, with the separator 1 with the recesses 20, when the arithmetic average roughness was 1.52 micrometers, the maximum height was 10.10 micrometers, and the ten point average roughness was 7.24 micrometers, no streaky toner image appeared on the recording medium 9. When the arithmetic average roughness was not smaller than 2.02 micrometers, the maximum height was not smaller than 18.75 micrometers, and the ten point average roughness was not smaller than 11.54 micrometers, a streaky toner image appeared. However, when the arithmetic average roughness was not greater than 0.21 micrometers, the maximum height was not greater than 2.21 micrometers, and the ten point average roughness was not greater than 0.95 micrometers, no faulty conveyance of the recording medium 9 occurred.

Accordingly, the separator 1 with the recesses 20 according to this example embodiment increases the ranges of the arithmetic average roughness, the maximum height, and the ten point average roughness that achieve both the desired image quality and the desired conveyance of the recording medium 9 by about twice as great as those achieved by the comparative separator without the recesses 20. Consequently, the components constituting the separator 1 enhance surface property of the recording medium conveyance face 10 of the front 1*c*.

Figure 8:
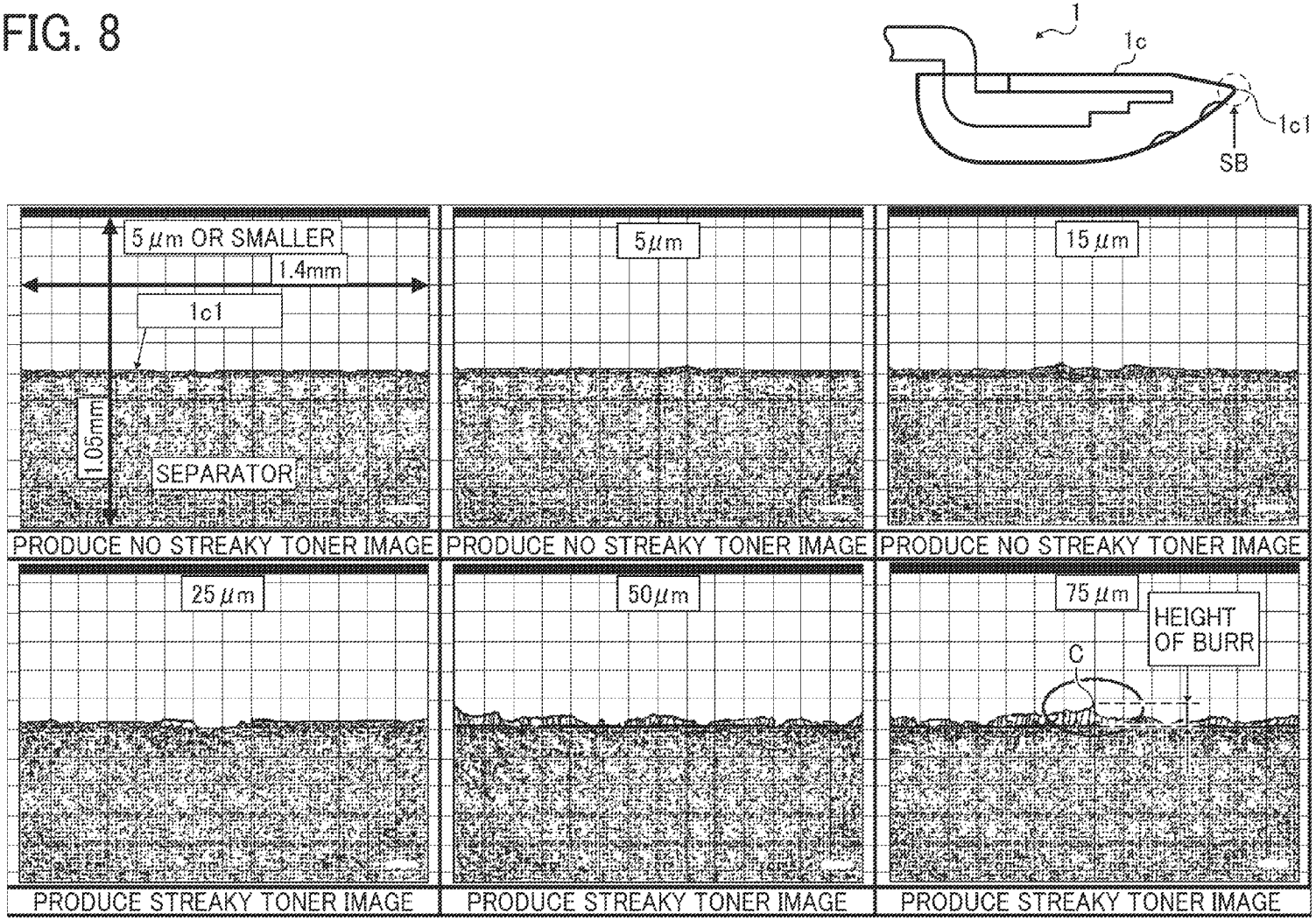
FIG. 8 is a diagram illustrating the separator shown in FIG. 6B and observation results for observing burrs produced thereon.

With reference to FIG. 8, a description is provided of burrs produced on the separator 1.

FIG. 8 is a diagram illustrating the separator 1. As shown in FIG. 8, the front 1*c* of the separator 1 includes a front edge 1*c*1 indicated by the dotted line. During a manufacturing process in which the front 1*c* is produced by resin molding or coating, burrs C (e.g., projections) may be created on the front edge 1*c*1 of the front 1*c*. If coated paper having a decreased rigidity is used as a recording medium 9, toner of the toner image on the recording medium 9 may be brought into contact with the front edge 1*c*1 of the front 1*c* of the separator 1 by the decreased rigidity of the recording medium 9. The burrs C created on the separator 1, depending on their size, may scratch the toner image on the recording medium 9, resulting in formation of a streaky toner image.

With reference to FIG. 8, a description is provided of an observation for observing burrs C created on the front edge 1*c*1 of the front 1*c* of the separator 1 indicated by the dotted line seen from a direction SB.

The observation was conducted with an electron microscope with ×10 lens (100 micron/div). A plurality of separators 1 was prepared and a height of burrs C produced on the front edge 1*c*1 of the respective separators 1 was measured by image capturing. As a thin coated sheet was conveyed, formation of a streaky toner image was observed. FIG. 8 shows observation results.

Burrs having a height not greater than 15 micrometers produced no streaky toner image. Conversely, burrs C having a height not smaller than 25 micrometers produced a streaky toner image. Hence, burrs C having a height smaller than 25 micrometers, preferably, not greater than 15 micrometers, suppress formation of a streaky toner image.

With reference to FIGS. 2, 3, 5B, and 6A, a description is provided of advantages of the separation device 7 according to the example embodiments described above.

As shown in FIGS. 2 and 3, the separation device 7 is situated downstream from a nip (e.g., the fixing nip N) formed between the two rotary bodies contacting each other (e.g., the fixing belt 3 serving as a first rotary body and the pressing roller 5 serving as a second rotary body) in the recording medium conveyance direction D1. The separation device 7 includes at least one separator 1 having the front 1*c* aligned in the axial direction of the rotary bodies. As shown in FIGS. 5B and 6A, the recording medium conveyance face 10 of the front 1*c* of the separator 1 is produced with a recess 20 extending in the extension direction A perpendicular to the recording medium conveyance direction D1. The surface roughness of the recording medium conveyance face 10 is defined by the arithmetic average roughness not greater than about 1.5 micrometers, the maximum height not greater than about 10.0 micrometers, or the ten point average roughness not greater than about 7.2 micrometers. The front 1*c* of the separator 1 includes the front edge 1*c*1 on the recording medium conveyance face 10. A burr C produced on the front edge 1*c*1 has a height not greater than about 25 micrometers.

Accordingly, the recording medium conveyance face 10 of the separator 1 contacts the recording medium 9 bearing the toner image in a reduced area, preventing toner of the toner image from adhering to the separator 1. Further, even if thin coated paper having a decreased rigidity is used as a recording medium 9, the separator 1 conveys the thin coated paper precisely. Accordingly, the separator 1 of the separation device 7 prevents a streaky toner image that may be formed as the toner image on the thin coated paper slides over the separator 1 or toner adhered to the separator 1 scratches the toner image on the recording medium 9. Consequently, the image forming apparatus 30 incorporating the separation device 7 attains formation of a high quality toner image and precise conveyance of the recording medium 9.

According to the example embodiments described above, the fixing belt 3 serves as a fixing rotary body or a first rotary body. Alternatively, a fixing roller or the like may serve as a fixing rotary body or a first rotary body. Further, the pressing roller 5 serves as a pressing rotary body or a second rotary body. Alternatively, a pressing belt or the like may serve as a pressing rotary body or a second rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A separation device disposed downstream from a first rotary body and a second rotary body contacting the first rotary body in a recording medium conveyance direction in which a recording medium is conveyed between the first rotary body and the second rotary body, the separation device comprising:

at least one separator disposed opposite one of the first rotary body and the second rotary body, each of the at least one separator including:

a front aligned in an axial direction of the one of the first rotary body and the second rotary body and including a recording medium conveyance face over which the recording medium slides, the recording medium conveyance face including a front edge produced with a burr extending from an outer surface of the at least one separator having a height not greater than about 25 micrometers; and a recess produced on the recording medium conveyance face and extending in a direction perpendicular to the recording medium conveyance direction, wherein the recording medium conveyance face has a surface roughness defined by one of an arithmetic average roughness not greater than about 1.5 micrometers, a maximum height not greater than about 10.0 micrometers, and a ten point average roughness not greater than about 7.2 micrometers.

2. The separation device according to claim 1, wherein the separator contacts one of the first rotary body and the second rotary body.

3. The separation device according to claim 1, wherein the separator is disposed opposite one of the first rotary body and the second rotary body with a given interval therebetween.

4. The separation device according to claim 3, wherein the given interval is in a range of from about 0.1 mm to about 0.6 mm.

5. The separation device according to claim 1, wherein the recording medium conveyance face of the separator is coated with fluoroplastic.

6. The separation device according to claim 1, wherein the front of the separator is made of fluoroplastic.

7. The separation device according to claim 1, wherein the recess extends substantially throughout an entire width of the front of the separator in the direction perpendicular to the recording medium conveyance direction.

8. The separation device according to claim 1, wherein the separator further includes:

a base integrally molded with the front; and a shaft mounted on the base.

9. The separation device according to claim 8, further comprising:

a compression spring anchored to the base of the separator; and a screw to press the compression spring, wherein as the screw presses the compression spring, the base of the separator rotates about the shaft thereof.

10. The separation device according to claim 8, wherein the base of the separator rotates about the shaft thereof to bring the front of the separator into contact with one of the first rotary body and the second rotary body.

11. The separation device according to claim 8, wherein the base of the separator rotates about the shaft thereof to isolate the front of the separator from one of the first rotary body and the second rotary body with a given interval therebetween.

12. The separation device according to claim 8, wherein the front of the separator is softer than the base of the separator.

13. An image forming apparatus comprising the separation device according to claim 1.

14. The separation device according to claim 1, wherein the burr has a height greater than zero micrometers and not greater than about 25 micrometers.

15. A fixing device comprising:

a first rotary body;

a second rotary body contacting the first rotary body; and a separation device disposed downstream from the first rotary body and the second rotary body in a recording medium conveyance direction in which a recording medium is conveyed between the first rotary body and the second rotary body, the separation device including at least one separator disposed opposite one of the first rotary body and the second rotary body, each of the at least one separator including:

a front aligned in an axial direction of the one of the first rotary body and the second rotary body and including a recording medium conveyance face over which the recording medium slides, the recording medium conveyance face including a front edge produced with a burr extending from a surface of the at least one separator having a height not greater than about 25 micrometers; and a recess produced on the recording medium conveyance face and extending in a direction perpendicular to the recording medium conveyance direction, wherein the recording medium conveyance face has a surface roughness defined by one of an arithmetic average roughness not greater than about 1.5 micrometers, a maximum height not greater than about 10.0 micrometers, and a ten point average roughness not greater than about 7.2 micrometers.

16. The fixing device of claim 15, wherein the burr has a height greater than zero micrometers and not greater than about 25 micrometers.

* * * * *